US005606776A

United States Patent [19]

Freund et al.

[11] Patent Number: 5,606,776

[45] Date of Patent: Mar. 4, 1997

[54] CHUTE FEEDER FOR TEXTILE PROCESSING EQUIPMENT

[75] Inventors: Kenneth S. Freund, Hendersonville; Andrew J. Giles, Joelton, both of Tenn.; James S. Bailey, Arlington, Va.

[73] Assignee: E. I. Du Pont de Nemours and Company, Wilmington, Del.

[21] Appl. No.: 550,551

[22] Filed: Nov. 7, 1995

Related U.S. Application Data

[63] Continuation of Ser. No. 407,147, Mar. 20, 1995, abandoned.

[51] Int. Cl.[6] ..... D01G 15/40

[52] U.S. Cl. ..... 19/105; 19/66 R

[58] Field of Search ..... 19/65 R, 66 R, 19/97.5, 105, 296, 303, 304, 200, 203, 204, 205, 99.5, 145.5

[56] References Cited

U.S. PATENT DOCUMENTS

| | | | |
|---|---|---|---|
| 3,487,509 | 1/1970 | Bond | 148/105 |
| 3,738,476 | 6/1973 | Hullett et al. | 198/58 |
| 3,981,047 | 9/1976 | Contractor et al. | 19/105 |
| 4,154,485 | 5/1979 | Lytton et al. | 19/105 |
| 4,351,793 | 9/1982 | Day | 264/518 |
| 4,353,686 | 10/1982 | Hosler et al. | 425/83.1 |
| 4,449,272 | 5/1984 | Cash | 19/105 |
| 4,930,190 | 6/1990 | Leifeld | 19/105 |
| 5,157,809 | 10/1992 | Genevray | 19/105 |
| 5,303,455 | 4/1994 | Leifeld | 19/105 |

*Primary Examiner*—Amy B. Vanatta
*Assistant Examiner*—Larry D. Worrell, Jr.

[57] ABSTRACT

This invention relates to the creation of a different styled batt from tufts of fiber for delivery to textile machinery. In particular, the batt formed in the style of this invention is particularly suited for delivery to a carding machine. Carding machines are able to more fully utilize fiber processing capacity with lower risk of becoming overloaded because the tufts are less able to be pulled out of the batt intact but are held back allowing for the lickerin roll or other feed arrangement to pull fiber out of the batt in a more continuous and uniform manner.

12 Claims, 4 Drawing Sheets

CHUTE FEEDER FOR TEXTILE PROCESSING EQUIPMENT

This is a continuation of application Ser. No. 08/407,147 filed Mar. 20, 1995, now abandoned.

FIELD OF THE INVENTION

This invention relates to processes and apparatuses for collecting dry textile fiber and delivering the collected fiber to textile machinery and more particularly to processes and apparatuses for forming the collected dry textile fiber into a batt to be fed to a textile machine.

BACKGROUND AND SUMMARY OF THE INVENTION

Many types of textile processing equipment, such as carding machines and airlay web formers, are designed to receive textile fiber from a bale in the form of a batt wherein the batt is formed of a collection of tufts of fiber. In the operation of such textile equipment, the tufts are conventionally pulled or taken whole into the textile equipment. Exceptionally large tufts may overload the textile equipment by providing too much fiber at once. Thus, it is preferred that the batts are formed with smaller tufts therein and the feed rates are set to accommodate the largest remaining tufts. In addition, bale opening equipment and perhaps other equipment is used to open the bales of fiber and break the tufts into smaller clumps of fiber to facilitate less overloading of equipment and higher feed rates.

To fully understand the problem and solution proposed by the present invention, a common understanding or definition of the word "tuft" may be necessary. In this specification, "tuft" has a somewhat different meaning from that which is commonly used to describe the fiber in a tufted carpet. The word "tuft" is used herein to describe clumps of fiber or a bunch of individual fibers attached together wherein the individual fibers in the tuft are cohesively connected and have not been opened up, separated or combed by carding equipment, airlay equipment or the like. It should be noted that tufts are often clumped together especially when pressed into a batt, but the tufts tend to maintain individual identity by their stronger cohesive attachments. In general, fiber is in the form of tufts when it is raw fiber haven been taken directly from a bale. Tufts are often formed in man-made fiber at the time the tow is chopped or crimped. Many natural fibers, such as cotton, form into tufts because they grow around seeds to provide a sort of "parachute" to carry and disperse seeds by wind from the plant. Such tufts may be separated into smaller tufts by cleaning and picking equipment used to process the cotton into usable fiber. The individual fibers are typically not truly entangled with one another, although it may sometimes appear to the untrained observer that they are. Rather, the fibers are attached or connected together by cohesive forces, although such cohesive forces are not so strong that the tufts cannot be easily pulled apart by hand.

Tufts are light and lofty with fibers radiating out therefrom thus being generally reactive to any flow of air, such as the natural fiber is for dispersing the seeds away from the plant. Each tuft generally comprises a substantial number of individual fibers which are quite randomly oriented therein. To convey a visual sense of what a tuft looks like, the fibers which are used by DuPont in the making of its Sontara® spunlaced fabrics are typically between ¾" to about 1½" in length and are relatively straight or have a small amount of crimp therein. The tufts formed by such fibers are randomly sized puff balls of irregular shape and density from ½" to 3½" in diameter. Fibers having longer lengths or more crimp will typically make for tufts having a different range of sizes probably including larger tufts. The tufts do not have the uniform density or regular shape of a cotton ball one normally has in their medicine cabinet, but there is some analogy to the size and loftiness of a cotton ball. It should be noted that the fibers in a cotton ball have been combed or carded to separate the individual fibers and the fibers have been arranged to provide the rounded shape, so the comparison is for illustration purposes only. In any event, one should understand that the tufts are rather light, soft and readily deformable. The tufts also tend to move with and be very reactive to any flow of air in their vicinity.

As noted above, the feedrates of carding equipment and airlay web formers are limited by the size of the largest tufts in the batt. The batts are typically formed by chute feeders which are designed to form a batt of preferably uniform thickness and density. Such chute feeders simply stack the tufts of fiber in a channel having a width approximately that of the carding machine and a thickness of approximately the thickness of the batt. For examples of conventional chute feeder design, there are a number of issued U.S. patents illustrating chute feeders, such as U.S. Pat. No. 3,738,476; U.S. Pat. No. 4,154,485; U.S. Pat. No. 4,449,272; U.S. Pat. No. 4,930,190; and U.S. Pat. No. 5,157,809.

By the present invention, a batt may be created by an improved chute feeder wherein the batt is formed of essentially the same fiber tufts as conventional batts, but the feed rate of the new style batt into textile equipment may be increased without regard to the size of the largest tuft. The new styled batt is believed to provide improvement for most textile machinery arranged to be fed such batts made of tufts, but the performance is particularly unexpected and dramatic when considered for carding machines. The functional difference between the conventional batt and the new batt is that the new batt is designed or arranged to provide a natural resistance to an entire tuft being pulled whole into the feed mechanism of the textile machine. With the new style batt, the tufts are either drafted out (elongated) between the feed rolls and the lickerin roll or the tuft is simply disassembled by the lickerin at the feed rolls. In comparison, a conventional batt from an above described conventional chute feeder readily provides whole tufts to the lickerin roll. As such, the tuft must be drafted and/or disassembled on the carding roll. As described before, whole tufts tend to fill the capacity of the card and extra large tufts may overload the capacity. Thus, feed rates for cards have historically been set to accommodate the largest tufts to avoid overloading the carding roll.

By observing that the pick up mechanisms for most types of textile processing machinery often pick up such clumps or tufts in their entirety, it was speculated that if a batt could be formed which did not allow whole tufts to be fed into the carding machine, that the feed rate could be increased. In tests, the new type of batt provides a considerable improvement in throughput for a carding machine. At the present time, the improvement is approximately three times current throughput, but it is believed that production rates approaching six times current throughput, and maybe higher, are attainable. This is astounding under any circumstances, but it is particularly amazing in light of the fact that most conventional carding technology has been around for many decades.

The basic underlying structural difference between the conventional batt and the new batt relates to the orientation of the tuft in the batt. In the conventional batt, the tufts end up stacked in the chutes and are compressed down by the weight of the tufts on top thereof. As such, the tufts tend to become flattened out horizontally like pancakes in an orientation which is essentially perpendicular to the batt. When such batts are delivered to the feed mechanism, typically turned 90° to be in a horizontal orientation, the tufts or layers are upright and vertical so that they may be easily peeled from the batt and pulled whole onto the lickerin roll. In the new type of batt, the tufts are also flattened, but they are flattened so that they lie essentially flat within the batt or close to parallel with the plane of the batt.

In the operation of the new chute feeder for making the new style batt, the tufts tend to form layers or "shingles" which are highly overlapped in a generally linear imbricated pattern. Thus, the shingles are arranged such that when the batt is compressed between two rolls or two conveyor belts or the like, each shingle is pressed between layers of shingles from both above and below for a substantial part of its length (in the machine direction). Thus, the new batt is arranged to retain the majority of each shingle, and therefore the majority of each tuft, pinched between the feed rolls as the leading edge thereof is pulled onto the lickerin roll. As the batt is continuously fed to the lickerin, the shingles and tufts are "nibbled" or pulled apart across the layers of the batt rather than the lickerin pulling a single layer or tuft whole. Thus, the "new" batt enables fiber to be fed to textile equipment at a more constant rate.

Accordingly it is an object of the present invention to provide a process and equipment for creating a batt suitable for being fed to textile equipment that overcomes the deficiencies and drawbacks of the conventional arrangements as described above.

It is more particularly an object of the present invention to provide a process and apparatus for creating a batt suitable for being fed to textile equipment wherein the tufts of fiber comprising the batt are controlled so as not to be delivered intact to the textile equipment.

The above and other objects of the invention are accomplished by the provision of a process for assembling a batt comprising providing loose, highly lofted tufts. In the process, the loose, highly lofted tufts are provided into the top portion of a generally vertically oriented chute to pass with a flow of air down therein to a foraminous conveyor belt generally at the bottom portion thereof. The foraminous conveyor belt moves along a machine direction under the chute to carry the batt being formed thereon out of the bottom of the chute and to a carding machine or the like where the tufts are collected on the foraminous conveyor belt to form overlapping shingles by drawing air down through the belt from the upper surface thereof such that the air transmission rate through the belt is substantially uniform along the machine direction taking into account that the fiber batt is substantially thicker at one end of the hopper as compared to the other.

BRIEF DESCRIPTION OF THE DRAWINGS

Some of the objects of the invention have now been stated and others may become apparent as the description of the invention proceeds. The invention may be more easily understood by reference to the accompanying drawings in which.

DETAILED DESCRIPTION OF THE PREFERRED EMBODIMENTS

Figure 1:
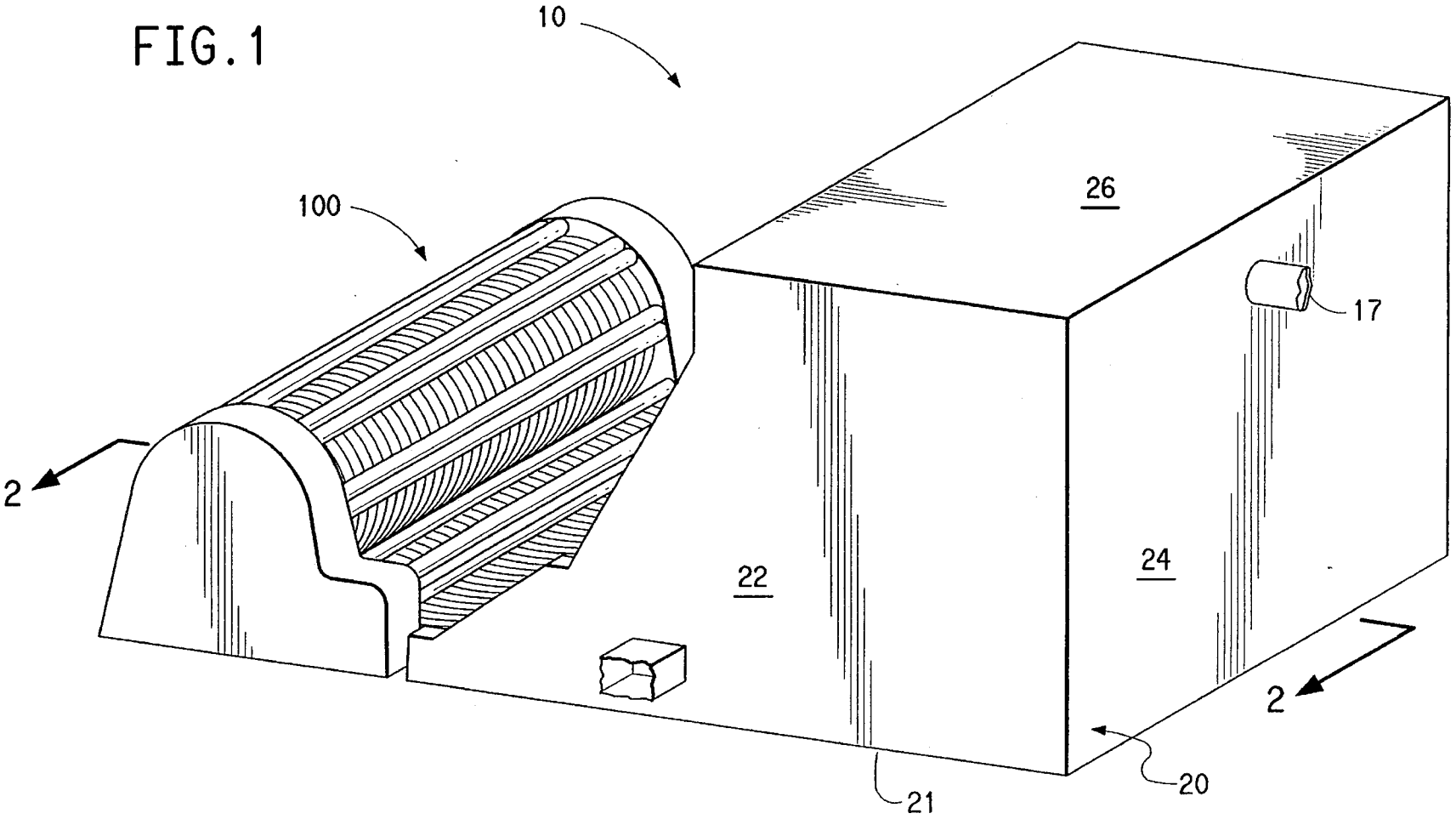
FIG. 1 is a perspective view of a preferred embodiment of a chute feeder arranged to feed a batt to a carding machine.
Figure 2:
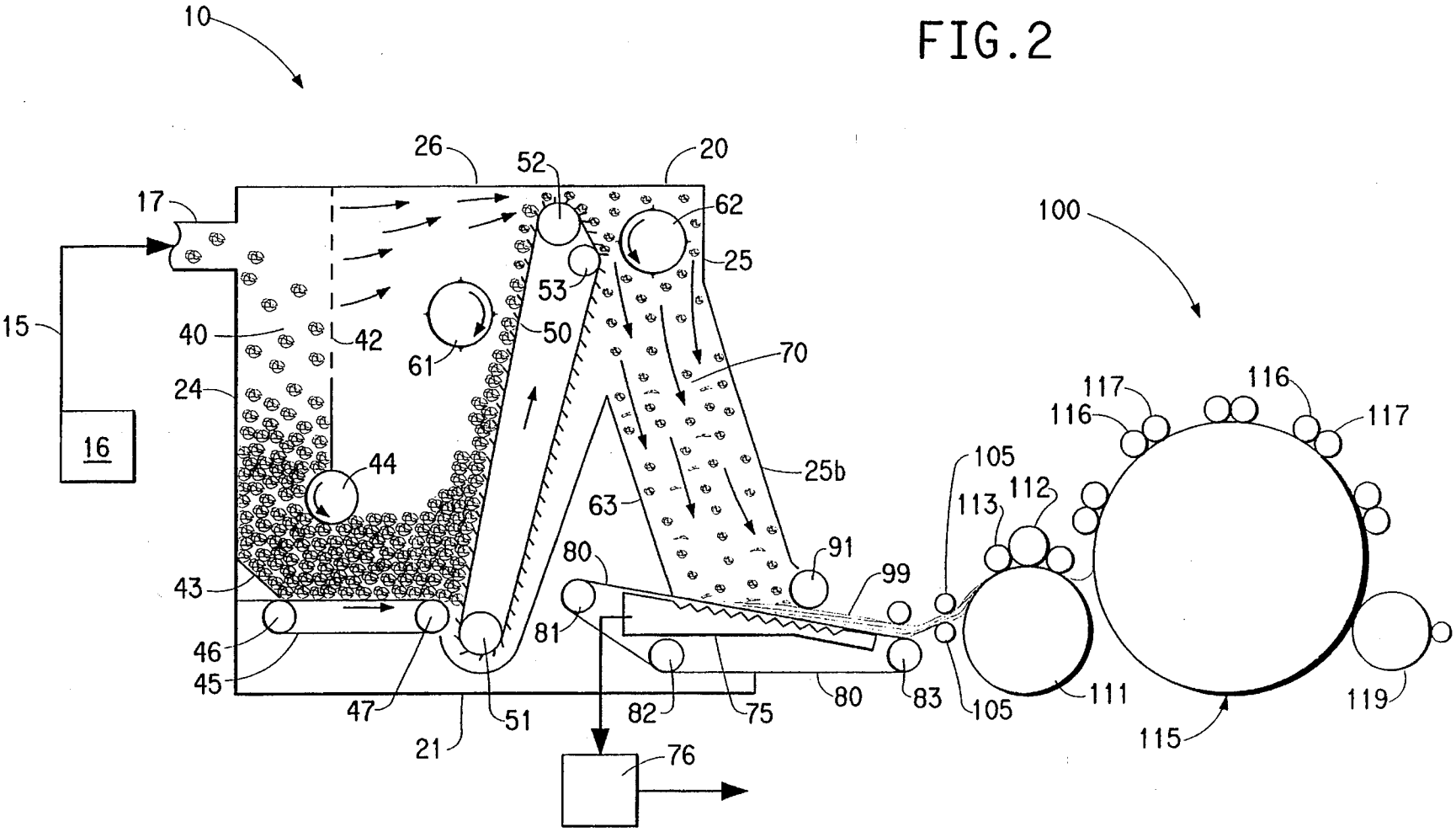
FIG. 2 is a side cross sectional view of the chute feeder and carding machine taken along line 2—2 of FIG. 1.

Referring now to FIGS. 1 and 2, a first preferred embodiment of a chute feeder is generally indicated by the number 10. The chute feeder 10 is provided with fiber, as indicated by stream 15, which may be provided from a suitable source of raw fiber 16 via conventional means, such as pneumatic conveying system including conduit 17. The raw fiber source 16, as would be typical of most textile processing plants, would be fiber in tightly compacted bales. The fiber in the bales is taken from the bales and opened up by conventional equipment such as bale breakers, openers and the like and provided into a pneumatic conveyor system. The chute feeder 10 is arranged to form a generally continuous batt 99, and deliver the batt 99 to a carding machine, generally indicated by the number 100.

The chute feeder 10 comprises a substantially closed housing, generally indicated by the number 20, and in the preferred embodiment is generally defined by a base 21, side walls 22 and 23, a back wall 24, a front wall 25 and a top wall 26. The fiber from conduit 17 is delivered to a bin portion 40.

The bin portion 40 is essentially a hopper for receiving fiber and administering it to the arrangement for forming a batt. This batt forming arrangement will be described later. The bin portion 40 is generally defined by the back wall 24, rear portions of the side walls 22 and 23, the top wall 26 and a first dividing wall 42. A conveyor belt 45, carried by rolls 46 and 47, is provided generally at the base of the bin portion 40 to receive the fiber thereon and move it forward in the chute feeder 10. The conveyor belt 45 preferably extends the width of the bin portion 40 and may include a rough surface, slats, or the like to carry the fiber along therewith. A short ramp wall 43 extends downwardly from the back wall 24, at an angle thereto, to a portion of the conveyor belt 45 generally at the roll 46 to substantially direct fiber onto the conveyor belt 45 and not to pass around the conveyor 45 and get down to the bottom wall 21.

The dividing wall 42 is spaced from and generally parallel to the back wall 24 to form a generally rectangular cross sectional bin. Other cross sectional shapes may also be suitable, but it is preferred that the fibers are distributed laterally to the width of the batt to be formed by the chute feeder 10. It is preferred, as shown, that the chute feeder be comparable to the operating width of the carding machine 100 or whatever textile equipment is to receive the batt 99. The dividing wall 42 includes a perforate section 43 which is preferably large to allow additional air carrying the fiber in the pneumatic conveyor to separate therefrom and pass through and out of the bin portion 40 as indicated by the arrows.

A rotating drum roll 44 is positioned at the base of dividing wall 42, and works in conjunction with the conveyor 45 to carry the bulk fiber in the bin portion 40 to the base of the inclined conveyor belt 50. The roll 44 may also include a coarse surface to better move the fiber forward in the system, as would be known by those versed in the art.

The inclined conveyor belt 50 is carried by rolls 51, 52 and 53, and preferably extends the width of the housing 20 of the feeder 10. The belt 50 preferably includes spikes or other conventional implements thereon to lift fiber at a near vertical angle (approximately 60 to 85 degrees from the horizontal) to overlie a chute portion, generally indicated by the number 70. With the spikes on the conveyor belt 50 lifting up through a mound of fiber piled up against the base thereof, the conveyor belt 50 continuously collects a substantially uniform amount of fiber for delivery to the chute portion 70, considered in both the machine direction (MD) and the cross machine direction (XD). Leveling roll 61 is arranged to knock off excess fiber from the conveyor belt 50 and return it to the mound formed at the base thereof and therefore render a more uniform delivery of fiber to the chute portion 70. Leveling roll 61 rotates counter to the movement of the conveyor belt 50 and may include spikes, pins or brushes to sweep away fiber that is not well secured on the spikes of the conveyor 50.

As noted above, the upper portion of the conveyor 50 overlies a chute portion 70. The chute portion 70 is a substantially vertically oriented channel having a relatively large, generally rectangular cross section and is generally defined by the front wall 25, the front portions of side walls 22 and 23, top wall 26 and the conveyor belt 50. At the bottom of the chute portion 70, is a foraminous conveyor belt 80 carried by rolls 81, 82 and 83. A chute ramp 63 is positioned to extend downwardly from about the midpoint of the conveyor belt 50, at an angle thereto, to a portion of the conveyor 80 generally at the roll 81 to direct the fiber onto the conveyor 80 in a similar fashion similar to the action of the short ramp wall 36 in the bin portion 30. One of the notable attributes of the chute portion 70, as will be explained in more detail later, is the substantial dimension at its base or, more particularly, at the conveyor belt 80. In the preferred embodiment, the base is approximately three and a half feet long in the machine direction. It is also preferred that the chute portion 70 has at least a constant horizontal cross section or more preferably a continually increasing horizontal cross section descending from the upper portion to the base.

The conveyor belt 80, as noted above, is foraminous to allow air to pass therethrough while collecting the fiber thereon. Immediately below the conveyor belt 80, and running coextensive therewith, is a vacuum box 75 which underlies and supports the conveyor belt 80. The vacuum box 75 extends across the width of the chute feeder 10 and coextends with the conveyor 80 for a substantial portion of the upper run between rolls 81 and 83. The vacuum box 75 is connected to a blower 76, of conventional design, to draw air down through the conveyor 80. Optionally, the blower 76 may form part of the pneumatic conveyor system 17.

The chute portion 70 is arranged such that fiber is received from the conveyor 50 and proceeds down the chute portion 70 to the conveyor belt 80. The chute feeder 10 includes an entrainment roll 62 adjacent the upper roll 52 of the conveyor belt 50 to disperse the fiber into the air flow moving down the chute portion 70. The fiber is separated from the conveyor belt 50 by the rapidly flowing air at the top portion thereof. As best seen in FIG. 2, there is a rather narrow channel for the air to flow through between the portion of the top wall 26 and the upper portion of the conveyor 50. The air flow indicated by the many arrows in the drawing figure are concentrated in the narrow channel causing relative higher speeds for dislodging the fiber and then carrying the fiber into the upper portion of the chute portion 70. Preferably about half of the air flow (and the fiber being carried by such air) goes over the entrainment roll while the other half goes under (or between the entrainment roll 62 and the conveyor 50) so as to fully disperse the fiber across the cross section of the chute portion 70. The fiber is dispersed in and controlled by an air flow which descends down the chute portion 70 so as to appear like a heavy snow storm. The downward moving air flow passes through the foraminous belt 80 and continues into the vacuum box 75 and on to the blower 76.

Figure 3:
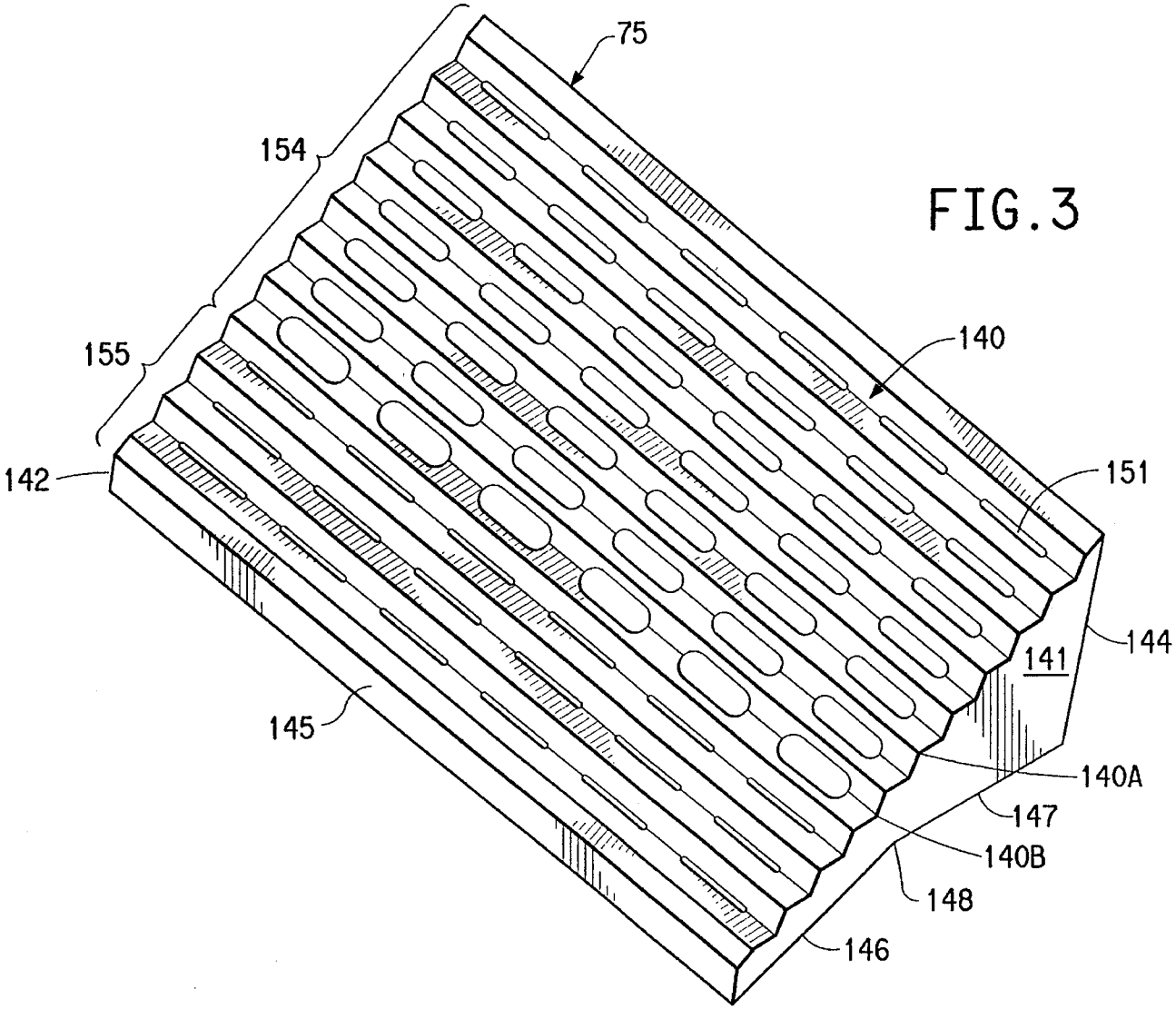
FIG. 3 is a perspective view of the suction box taken out of the chute feeder but which is used in the chute feeder, in part, to obtain an overlapping shingle feature of the batt.

The vacuum box 75, as best seen in FIG. 3, comprises a substantially closed box generally comprising a corrugated upper panel 140, side panels 141 and 142, back panel 144, front panel 145, a first bottom panel 146 and a second bottom panel 147. The two bottom panels 146 and 147 intersect at a junction line 148. The corrugated upper panel 140 has a surface which is best understood by reference to the drawings. In particular, the surface is configured with alternating peaks 140A and valleys 140B running generally transverse to the belt 80. Each of the peaks 140A and valleys 140B are preferably arranged such that they are relatively sharply angled. Thus, the portions of the corrugated upper panel 140 which are between the peaks 140A and valleys 140B are generally flat portions arranged at an angle to the belt 80 which overlies the corrugated upper panel 140. The corrugated upper panel further includes a number of openings 151 therein arranged at or near the valleys 140B in extending transversely across the vacuum box 75.

Before proceeding further with the description of the openings in the corrugated upper panel 140, it should be noted that the vacuum box 75 functions as a conduit through which air is pulled down through the belt 80 in a particular fashion. The vacuum box can be divided into two distinct sections. A first section may be generally identified as the laydown portion 154 generally extends across the width of the vacuum box and from the back panel 144 to about the junction line 148. The second section is the holddown portion 155 and it comprises the remainder of the vacuum box which is fully across the box and from the junction line 148 to the front panel 145. The laydown portion 154 may be characterized in that it has openings 151 which, as clearly shown in the drawings, are arrayed such that each succeeding valley 140B starting from the back panel 144 has a slightly larger width or dimension than the openings in the preceding valley. The holddown portion 155 may be characterized by having openings 151 which are smaller than most if not all the openings in the laydown portion 154 and all the openings in all the valleys are approximately the same dimension.

The relative sizes of the laydown portion 154 to the holddown portion is preferably about three quarters laydown portion to one quarter holddown portion. However, it is anticipated that a suitable range would be to have ratio be roughly half each up to about 90 percent laydown and 10 percent holddown. In the preferred embodiment, the dimension of the openings transitions from about 24 total square inches in each valley up to about 50 square inches maximum total area. The openings in the holddown portion of the upper panel are about 16 square inches total area per valley. However, there are many factors which should be considered when designing for balanced flow such as the desired basis weight of the batt to be formed, the denier of the fiber used in the chute feeder, and the flow characteristics of the foraminous belt, etc.

The reason for the progressively larger series of openings 151 followed by several smaller dimension openings may be best understood by reference to FIG. 2. The tufts are provided into the top of the chute portion 70 and are carried down to the surface of the foraminous belt 80 with the air flow therein. As a batt forms on the foraminous belt 80, the air flow which is intended to pass therethrough encounters greater resistance where the batt is thickest. The batt would inherently be thinnest near the roll 81 and thickest near the roll 91. Without variation in the openings 151 in the laydown portion 154, the air flow would tend to concentrate at the portion of the belt 80 near the roll 81. However, by varying the dimension of the openings, the air flow is generally balanced over the entire laydown portion 154. As such, the batt being formed accumulates fiber thereon in a more uniform manner. In other words, the resistance of air flow through the corrugated upper panel 140 is preferably arranged such that it offsets the increase in resistance created by fiber collecting on the belt 80.

As a result, the tufts actually form thin layers or shingles, which successively overlap in a manner that each successive shingle is slightly offset in the machine direction from the one below it. The formation of the shingles is clearly the result of the air being drawn down through the belt 80 and the tufts being so light to follow the air flow. The air naturally takes the path of least resistance which is where the fiber batt is the thinnest and the tufts that follow the air flow will quickly fill the voids. This process occurs continuously and is difficult to see when watching the chute feeder in operation. However, the batt 99 has clearly discernible layers formed therein that can be seen upon close inspection and disassembly of the batt 99. The improved operation of the textile machinery to which the batt is fed is also quite discernible.

In addition to forming thin and generally uniform thickness shingles, the system provides a naturally self balancing lateral distribution of the fibers across the width of the batt to be formed. Uniformity of the batt (in terms of basis weight) across the width thereof is a particular concern as it important for product quality as well as efficient use of raw material. A batt that has thin portions is not acceptable to customers and product that has excessively thick portions is wasteful of fiber (if it is acceptable for its intended use). The lateral distribution is accomplished in generally the same manner as described above, in that the air flow will favor the path of least resistance. The least resistance will be where the batt is the thinnest. As the air flow move to the thinnest portion of the batt, it brings additional fiber with it which brings the amount of fiber at the thin portion up to a more uniform distribution.

As described above, the adjacent layers or shingles within the batt are slightly offset from one another in a longitudinal direction because of the movement of the belt 80. The number of shingles which form the thickness of the batt 99 is dependent on a number of factors including the designed basis weight or total thickness of the batt 99, the length of the base of the chute portion 70, the nature of the tufts and the rate of operation of the chute feeder 10. By reference to FIG. 4, which will described in more detail below, there is illustrated a batt having about three and a half to four shingles in thickness when cut perpendicular to the length of the batt 99. In the preferred arrangement the batt would have more shingle layers, but for drawing clarity, the drawing shows fewer layers.

Referring again to FIGS. 2 and 3, once the batt 99 is formed on the belt 80 in the laydown portion 154, it passes under roll 91. Thereafter, the batt 99 is held down on the belt 80 over the holddown portion 155 of the vacuum box 75 in preparation for feeding to the card 100. The holddown portion tends to keep the batt from expanding significantly and also prevents it from being pulled back under the roll 91 by the very strong air flow in the laydown portion 154. The smaller dimension openings in the holddown portion 155 are suited to allow sufficient air flow therethrough to hold down the batt 99 substantially in its compressed state until the batt is to be pinched between subsequent rollers.

The compressed batt 99 is thereafter suited for delivery to the card 100. Carding machines are very old and well known and the card 100 is intended to represent any conventional design. In particular, the card 100 includes suitable feed rolls 105 which maintain the tight squeeze on the batt 99 as it is fed to lickerin roll 111. Lickerin roll 111 has a plurality of sharp needle like teeth for picking up the fiber from the batt 99. The lickerin roll 111 rotates substantially faster than the rate at which the batt 99 is fed thereto; however, with the batt tightly pinched between feed rolls 105 and the tufts arranged in overlapping shingles, the lickerin 111 is not able to easily pull out entire tufts intact. In the drawing, the lickerin 111 is provided with stripper and worker rolls 112 and 113.

The card 100 further includes a main carding roll and a plurality of stripper and worker rolls 116 and 117 both associated with the lickerin and with the main carding roll 115. The fiber that has been carded is then doffed by doffing roll 119 and discharged from the card. Once the fibers are carded they are more thoroughly separated from one another and arranged generally parallel to one another in the machine direction.

Although the Applicant has gone to great lengths to describe the card 100 as being conventional, using the batt formed by the process and apparatus of the present invention enables an operator of a conventional card to increase its throughput dramatically. Typically, cards are not able to be fed substantial rates of fiber because cards become quickly overloaded rendering product with many neps and streaks which are very difficult if not impossible to remove. If the overloading is substantial and for extended periods of time, the card may overheat and melt most polymer fibers. While this is rare and very unlikely under present operating scenarios, using conventionally assembled batts at the feedrates that Applicant has found possible with the chute feeder of the present invention would cause significant streaking, nepping, overheating and perhaps many other significant but uncommon problems. However, in contrast to such beliefs or expectations, carding machines have been found to be able to produce quality product at the significantly higher feedrates. The difference is not that more fiber is being loaded onto fully loaded portions of the card, but that the new batt is able to more fully utilize the full capacity of the card.

To put this in other terms, when using a conventional batt, full tufts are picked up by the lickerin. If a large tuft or a clump of tufts are picked up by the lickerin whole, the card would probably be overloaded at that position and the web product would reveal the consequences. The conventional manner of avoiding this likelihood is to set the feed rate so that the card has the opportunity to handle large mils. Thus, the feedrate across the full width of the card would be considerably irregular such that in some places, a tuft is being pulled in and the rate is at a maximum, while at others, there is little being added to the card and the feed rate is substantially below capacity. By the present invention, the feedrate across the width of the card is normalized such that the there are fewer and less radically low feedrate portions across the width of the card. The tufts in the new batt are either dismantled as the fiber therein is picked up by the lickerin, or the tuft remains somewhat intact but significantly drafted out. It may be helpful to visualize the batt of the present invention being "nibbled" by the lickerin roll in a substantially uniform manner across the width thereof rather than the irregular "bites" of individual tufts being fed from a conventionally formed batt.

Thus, in essence, the present inventors have developed a way of filling in the gaps on the carding roll so that more of the card is operating at or near capacity. As noted above, test results indicate that obtaining a feedrate improvement (i.e. the rate at which the batt is fed to the carding machine and not the speed at which the carding machine is run) of at least three times conventional feedrates is feasible while higher feedrates are envisioned.

Figure 4:
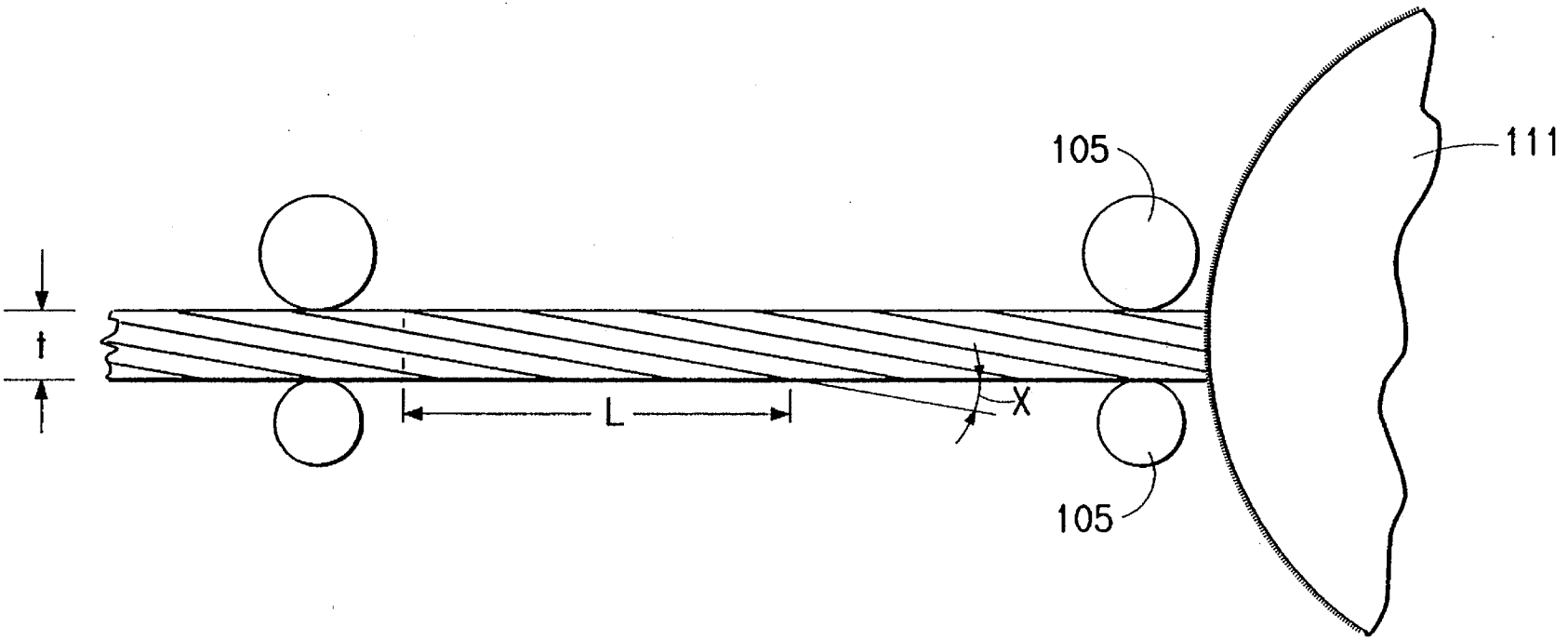
FIG. 4 is an enlarged fragmentary view of the compressed batt formed by the present invention particularly showing the overlapping shingle structure of the bait.

A section of the batt 99 is enlarged in FIG. 4 to more clearly show the angle of the shingles to the batt. In the preferred embodiment, the angles and lengths of the shingles are more extreme than shown, but for purposes of explanation and clarity, the angle and length dimension are shown as being less substantial. However, this notable difference between what would be preferred and what is illustrated should not have a bearing on what is covered by the claims which follow this description.

Continuing with the description of FIG. 4, the batt 99 is illustrated as being compressed between rolls wherein the dimensions of interest are the lengthwise dimension component 1 of the shingle in the batt 99, the thickness of the compressed batt t, and the angle $\alpha$ formed by the length l and thickness t. By simple trigonometry, the angle of the shingle in the batt may be derived by obtaining the arctan of t/l. This angle or the plane in which the shingle lies may also be described as the tuft plane since this is the general plane in which the flattened tufts are arranged. It should further be understood that theses dimensions and angles are measured while the batt 99 is compressed. Since the batt is intended to be fed to a textile machine, the batt 99 will most likely be compressed between rolls to control the delivery of the batt. Since the invention primarily relates to the form of the batt as it is delivered to the equipment, the measurement is most relevant in its compressed state.

It is also illustrated in FIG. 4 that the batt is fed in a somewhat radial orientation to the lickerin 111. The lickerin 111, as is conventional, has a card clothing exterior surface which includes many teeth. By arranging the shingles or tuft at the angle illustrated, the compressive forces exerted by the feed rollers 105 cause adjacent tufts to hold the remaining portions of the tuft in the batt while the fibers at the edge of the tuft are pulled out of the tuft without being able to easily pull the remainder of the tuft out.

We claim:

1. A system for assembling a continuous stream of loose, highly lofted tufts of randomly oriented staple length textile fibers into a generally continuous fiber batt comprised of substantially elongated shingles suited for high speed delivery to textile processing equipment such as a carding machine or the like, wherein the system comprises:

a substantially perforate conveyor belt having an upper surface for receiving the tufts thereon thus forming the batt on said upper surface;

means for moving said perforate conveyor belt along a predetermined path defining a machine direction;

a generally vertically oriented chute arranged generally over top of said conveyor belt having generally open top and bottom portions, generally closed side and front and back walls, wherein said front and back walls are arranged to span said perforate conveyor belt and said side walls extend along the machine direction generally adjacent opposite edges of said perforate conveyor belt, and particularly wherein said chute defines a substantially open free fall path for the tufts to descend from the top portion to said perforate conveyor belt;

means for delivering the tufts to said generally open top portion of said chute comprising a bin portion for receiving the fiber from a feed source, an inclined conveyor for lifting fiber continuously from the bin portion and depositing the fiber into said vertically oriented chute;

means for drawing air generally from above said upper surface of said substantially perforate conveyor belt down through said substantially perforate conveyor belt such that air transmission through the belt is substantially uniform along the machine direction taking into consideration that there will be more fiber nearer to said front wall of said chute as compared to said back wall of said chute;

whereby the batt is formed of continuous overlapping shingles which are suited for being controllably administered to a carding machine with reduced likelihood of permitting an entire tuft to be taken into the carding machine at once.

2. The apparatus according to claim 1 further including a narrow channel to create a high speed air stream to lift the fiber from the inclined conveyor.

3. The apparatus according to claim 2 further including an entrainment roll to mechanically dislodge fiber tufts remaining on the conveyor above said chute, and wherein the apparatus is arranged so that the air stream has an approximately balanced flow of fiber passing over and under the entrainment roll.

4. The system according to claim 1 wherein the shingles overlap preceding shingles and are arranged at an angle of less than 40 degrees from the belt.

5. The system according to claim 4 wherein the shingles are arranged at an angle of less than 25 degrees from the belt.

6. The system according to claim 4 wherein the shingles are arranged at an angle of less than 10 degrees from the belt.

7. The system according to claim 1 wherein the batt comprises a thickness of at least 5 shingles.

8. The system according to claim 7 wherein the batt comprises a thickness of at least 10 shingles.

9. A combination of a carding machine and a chute feeder wherein the chute feeder receives a continuous stream of loose, highly lofted tufts of randomly oriented staple length textile fibers and creates a generally continuous fiber batt comprised of substantially elongated shingles for high speed delivery to said carding machine which combs and separates the fibers for subsequent treatment, wherein the combination comprises:

a substantially perforate conveyor belt having an upper surface for receiving the tufts thereon thus forming the batt on said upper surface;

means for moving said perforate conveyor belt along a predetermined path defining a machine direction;

a generally vertically oriented chute arranged generally over top of said conveyor belt having generally open top and bottom portions, generally closed side and front and back walls, wherein said front and back walls are arranged to span said perforate conveyor belt and said side walls extend along the machine direction generally adjacent opposite edges of said perforate conveyor belt, and particularly wherein said chute defines a substantially open free fall path for the tufts to descend from the top portion to said perforate conveyor belt;

means for delivering the tufts to said generally open top portion of said chute;

means for drawing air generally from above said upper surface of said substantially perforate conveyor belt down through said substantially perforate conveyor belt such that air transmission through the belt is substantially uniform along the machine direction taking into consideration that there will be more fiber nearer to said front wall of said chute as compared to said back wall of said chute;

whereby the batt is formed of continuous overlapping shingles: and a carding machine comprising a lickerin roll, a main carding roll arranged to receive fiber from the lickerin roll, stripper and worker rolls for lifting fiber from the main card roll and combing the same and replacing the same back on the carding roll and a doffing means for taking fiber off the main card roll, wherein the batt fed onto the lickerin roll is controllable administered so that an entire tuft is unlikely to be taken thereon at one time.

10. The combination according to claim 9 wherein the shingles overlap preceding shingles and are arranged at an angle of less than 40 degrees from the belt.

11. The combination according to claim 10 wherein the shingles are arranged at an angle of less than 25 degrees.

12. The combination according to claim 11 wherein the shingles are arranged at an angle of less than 10 degrees.

* * * * *